United States Patent [19]

Milia

[11] 4,351,387

[45] Sep. 28, 1982

[54] SIEVE ASSEMBLY FOR CLEANING BODIES AND HEAT EXCHANGER SYSTEM INCLUDING SAME

[76] Inventor: Louis Milia, 16 Ellen Pl., Kings Park, N.Y. 11754

[21] Appl. No.: 167,160

[22] Filed: Jul. 8, 1980

[51] Int. Cl.[3] ..... F28G 13/00; B01D 35/02

[52] U.S. Cl. ..... 165/95; 15/3.51

[58] Field of Search ..... 165/95; 15/3.51

[56] References Cited

U.S. PATENT DOCUMENTS 4,283,807 8/1981 Bizard ..... 165/95

4,304,295 12/1981 Otake ..... 15/3.51 X

*Primary Examiner*—Samuel Scott

*Assistant Examiner*—Theophil W. Streule, Jr.

*Attorney, Agent, or Firm*—Louis E. Marn; Elliot M. Olstein

[57] ABSTRACT

There is disclosed a novel sieve assembly for collecting cleaning balls from a fluid passing through the tubes of a heat transfer system and comprised of a plurality of guide members having cleaning body support members disposed therebetween with the distance between guide members being at least equal to the diameter of the cleaning bodies and with the distance between the top surface of the guide members and the top surface of the cleaning body support members being at least 0.5 times such diameter.

14 Claims, 4 Drawing Figures

FIG. 1
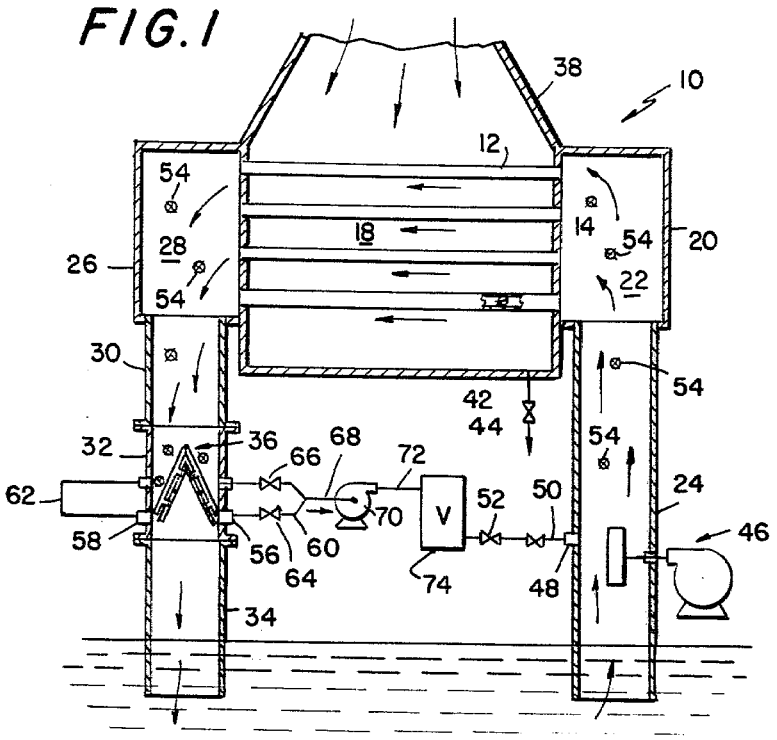
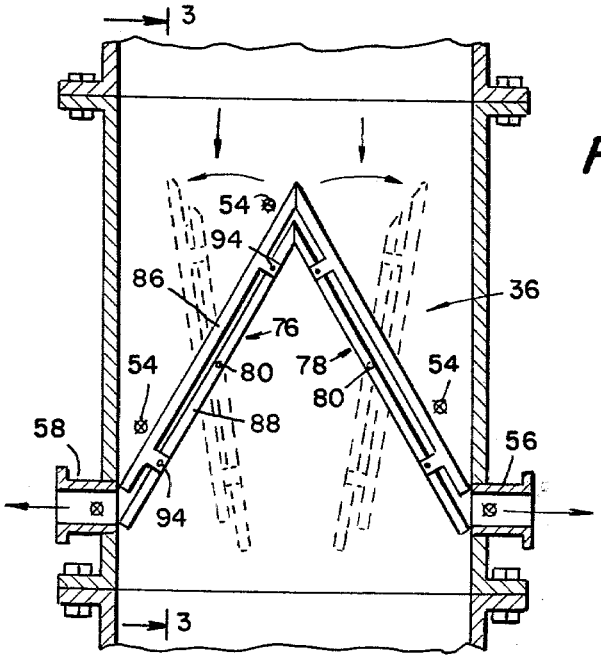
FIG. 2

SIEVE ASSEMBLY FOR CLEANING BODIES AND HEAT EXCHANGER SYSTEM INCLUDING SAME

This invention relates to an apparatus for on-line cleansing of tubes, and more particularly to a novel sieve assembly for use in a heat exchanger system for removing tube cleaning bodies from a fluid passing through the tubes of such heat exchanger system.

BACKGROUND OF THE INVENTION

In copending application Ser. No. 125,869, filed Feb. 29, 1980, there is disclosed a novel cleaning body for on-line usage in removing foreign materials from the internal surface of tubes of a shell and tube-type heat exchanger, such as a surface condenser. The cleaning body is comprised of a spherically-shaped core of an elastomeric material from which extend a plurality of radially extending filaments of an elastomeric material.

The use of cleaning bodies for heat transfer systems has been described, inter alia, in U.S. Pat. Nos. 1,795,348 to Schmidt; 2,801,824 and 3,021,117 to Taprogge; and 3,215,195 and 4,113,008 to Treplin. In such later references, the cleaning bodies are formed to an elastomeric material, such as sponge rubber having a diameter at least as great as the internal diameter of the tubes being cleaned, and preferably of a greater diameter. In addition to the problems arising from normal usage of sponge balls e.g. deaeration, short life periods and tendencies to collect in dead spots, the use of sponge balls also present problems of separation from the fluid, plugging of tubes due to lodged debris, etc. Separation is of particular concern, for ineffective separation, i.e. lost and discharge of the sponge balls from the system reduces cleaning efficiency.

In accordance with such aforementioned references, diverse intercepting means are employed in a conduit downstream of the tubular heat exchange to separate the cleaning bodies from the fluid in which said bodies are suspended, e.g. an inclined screen, a conically-shaped screen assembly including ring members, etc. The number of sieves or screens is determined by the diameter of the conduit and the diameter of the cleaning bodies with inclination being a function of fluid velocity and the relative hardness of the cleaning bodies.

The sieve or screen members are formed of bars or wire members spaced apart a distance substantially less than the diameter of the cleaning bodies and disposed at an inclined angle to fluid flow to permit the cleaning bodies to roll down the inclined surface to a collection zone from which the cleaning bodies are returned to the upstream side of the tubular heat exchanger of the heat exchanger system. Thus, the cleaning bodies are caused to roll down the sieve in contact with adjacent bar members, i.e. the cleaning bodies have a tendency to roll between the bar members, an area through which the fluid also flows. Such bar members are generally formed of rectangular stock, but have also been formed of other shapes, e.g. T-shaped bar stock, square-shaped bar stock, tapered bar stock, etc.

With the use of cleaning members formed of sponge rubber, fluid velocities through the sieve assembly are limited by the locking of such sponge bodies to the sieve by distortion of the cleaning body thereby, encountering difficulty in maintaining cleaning body circulation. For sponge rubber cleaning bodies having a diameter of about 1 inch, i.e. for cleaning tubes having an internal diameter of 0.9 inches, the spacing or gap between adjacent bar or wire member of the sieve assembly is in the order of 0.39 inches. The open area of the sieve and the pressure loss thru and across the sieve assembly, is affected by the inclination of the sieve assembly, the bar width and the gap. The pressure loss of clean sieves is the lowest obtainable for each particular design with pressure loss increasing as debris accumulates on the sieve bars and is locked in place on top of or in the sieve bars due to the velocity of the circulating fluid and the nature of the debris.

Accumulated debris is periodically removed from the sieve assembly by rotating sub-assemblies forming the sieve assembly and thereby backwashing the screen assembly since accumulated debris is detrimental to the circulation of the cleaning bodies. Sponge cleaning bodies have a tendency to accumulate behind the debris and or adhere to the screen assembly in a manner such that the periodic backwashing of debris concomitantly results in cleaning body losses with reduced cleaning effectiveness.

Since uniform fluid velocity is difficult to achieve across all parts of the screen assembly, fluid velocities are obtained which exceed the allowable limits for particular diameters, hardness, hardness with respect to bar gap, etc. thereby resulting in the penetration through the screen assembly of sponge cleaning bodies or at least their adherence thereto with or without debris accumulation. As hereinabove discussed, the screen assemblies result in the cleaning bodies rolling between or straddling adjacent bars which is detrimental to rolling movement since point contact on each of the bars allows for high deformation of sponge cleaning balls and creates a pivoting action which is frictionally resistant to rolling.

OBJECTS OF THE PRESENT INVENTION

It is an object of the present invention to provide an improved sieve assembly for a heat transfer system utilizing cleaning bodies for cleaning the internal surfaces of the heat exchange tubes thereof.

Another object of the present invention is to provide an improved sieve assembly for collecting cleaning bodies suspended in a fluid.

Still another object of the present invention is to provide an improved sieve assembly for collecting cleaning bodies suspended in a fluid substantially preventing the passage of such cleaning bodies through such sieve assembly.

A further object of the present invention is to provide an improved sieve assembly for collecting cleaning bodies suspended in a fluid of a configuration minimizing the lodging of debris.

A still further object of the present invention is to provide an improved sieve assembly for collecting cleaning bodies suspended in a fluid with reduced pressure drops across the sieve assembly.

Another object of the present invention is to provide a heat transfer system having improved on-line tube cleansing capabilities.

SUMMARY OF THE INVENTION

These and other objects of the present invention are achieved by a novel sieve assembly for collecting cleaning balls from a fluid passing through the tubes of a heat transfer system and comprised of a plurality of guide members having cleaning body support members disposed therebetween with the distance between guide members being at least equal to the diameter of the cleaning bodies and with the distance between the top surface of the guide members and the top surface of the cleaning body support members being at least 0.5 times such diameter. The sieve assembly is particularly advantageously used for separating and collecting cleaning bodies from a fluid when the cleaning bodies are comprised of a core from which radially extend a plurality of filaments, the ends of which define a superficial diameter of the cleaning body.

BRIEF DESCRIPTION OF THE DRAWINGS

Understanding of the present invention will be facilitated by referring to the following detailed description when taken in conjunction with the accompanying drawings wherein like numerals designate like parts throughout in which:

FIG. 1 is a schematic cross-sectional view of a heat transfer system employing the novel sieve assembly of the present invention;

FIG. 2 is an enlarged cross-sectional view of a downcomer therefor including sieve assembly;

DETAILED DESCRIPTION OF THE DRAWINGS

Figure 3:
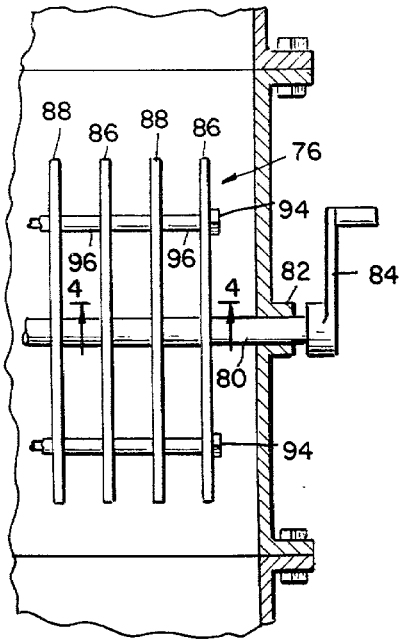
FIG. 3 is a partial view of the sieve assembly taken along the lines 3—3 of FIG. 2.

Referring now to FIG. 1, there is illustrated a surface condenser of the shell and tube-type design, generally indicated as 10, comprised of a plurality of tubes 12 disposed in an inlet tube sheet 14 and an outlet tube sheet 16 forming a shell condensing chamber 18. About the inlet tube sheet 14, there is provided a water box 20 defining an inlet water box chamber 22 in fluid flow communication with a source of cooling fluid by a conduit 24. About the outlet tube sheet 16 there is provided a water box 26 defining an outlet water box chamber 28 in fluid flow communication with the body of cooling fluid by an upper conduit 30, an intermediate conduit assembly 32 and a lower conduit 34 via a sieve assembly, generally indicated as 36, positioned within the intermediate conduit assembly 32. The condensing chamber 18 is in fluid flow communication by an inlet assembly 38 with a source of steam (not shown), such as the discharge side of a steam turbine. Condensate is collected in the bottom 40 of the condensing chamber 18 and is withdrawn via line 42 under the control of valve 44.

The cooling fluid medium is withdrawn from a source thereof by a circulation pump and motor assembly, schematically illustrated as 46, and is passed through conduit 24 to the inlet water box chamber 22. Downstream of the circulation assembly 46 there is provided a conduit 48 for introducing via line 50 under the control of valve 52 cleaning bodies, generally indicated as 54, such as described and claimed in copending application Ser. No. 125,869, comprised of a elastomeric core from which extend a plurality of elastomeric filaments for cleansing the internal surfaces of the tubes where the superficial diameter $d_s$ (the surface defined by the outer filament ends) of the cleaning bodies 54 are preferably larger than the internal diameter of the tubes.

The cleaning bodies 54 have a specific gravity equal to or greater than the specific gravity of the cooling fluid to provide for positive circulation. Random dispensing of the cleaning bodies 54 in the cooling fluid results in random selection of a tube 12 to be cleansed. Thus, while the number of cleaning bodies 54 need not be matched with the number of tubes 12 of the surface condenser 10, continuous circulation will effect cleansing of all of the tubes 12 thereof. Generally, the number of cleaning bodies 54 is determined by the number of tubes and desired frequency of cleansing. Cleansing of the tubes 12 is effected as described in the hereinabove discussed copending application.

The cooling fluid including cleaning bodies 54 withdrawn from the tubes 12 is passed through the water chamber 28 and into the conduit 30 in fluid communication with conduit assembly 32. In the conduit assembly 32, the cleaning bodies are separated by the sieve assembly 36 and collected in conduits 56 and 58 from which the cleaning bodies are passed through lines 60 and 62 under the control of valves 64 and 66, respectively, via line 68 by pump 70. The thus collected cleaning bodies are passed by line 72 to a collector assembly 74 in communication with line 50. The cooling fluid passes through the sieve assembly 36 and thence through conduit 34 to the source of cooling fluid.

In the conduit assembly 32, referring now to FIGS. 2 and 3, the sieve assembly 36 is comprised of two sieve portions, generally indicated as 76 and 78, fixedly mounted on shafts 80 journaled for rotation in bearing assemblies (not shown) disposed in shaft openings 82 formed in the conduit assembly 32. Crank levers 84 are fixedly mounted on the shafts 80 to effect rotation during operation into a position, indicated by the dash lines, to permit the removal of debris by the cooling fluid from the sieve portions 76 and 78 in a counter flow wash principle.

Figure 4:
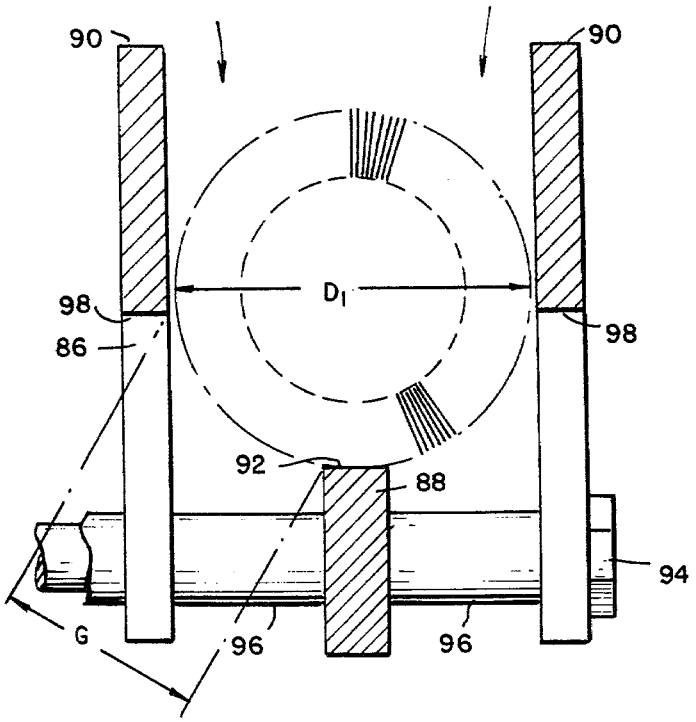
FIG. 4 is an enlarged cross-sectional view taken along the lines 4—4 of FIG. 3.

Each sieve portion 76 and 78 is formed of a plurality of guide rails 86 alternatingly spaced between support bars 88, also referring to FIG. 4, with the distance between the guide rails 86 being at least equal to, and preferably greater than the superficial diameter ($d_s$) of a cleaning body 54 to prevent locking of cleaning bodies 54 and with the distance between a top surface 90 of the guide member 86 and a top surface 92 of the cleaning body support member 88 being at least 0.5 times such diameter. The guide rails 86 and support bars 88 are positioned on threaded bolt and nut assembly 94, with spacer elements 96 positioned between guide rails 86 and support bars 88.

The guide rails 86 direct the cleaning bodies 54 to the support bars 88 whereby the cleaning bodies are guided over a support bar 88 at the best rolling position, i.e. the point of maximum radius. Such dimensional relationship between the guide rails 86 and the corresponding support bar 88 prevents the squeezing of the cleaning bodies 54 as contrasted to the sieve bars of the prior art, since deformation and force vectors are through the center line of a cleaning body and thus directed to the support bars 88.

As illustrated in FIG. 4 , the top wall 90 portion of the guide rails 86 preferably extends above the top portion of a cleaning body disposed therein, although a shorter length may be effectively utilized in sieve construction. The preferred length of the guide rails 86 directs the fluid flow occurring at various angles to the true axis of the conduit assembly 32 to minimize or eliminate any vector force attempting to force a cleaning body through opened area between the guide rails 86 and support bars 88, as well as to cause large pieces of debris to be disposed across or straddle adjacent guide rails 86 out of the collection path of the cleaning bodies 54.

The distance between a bottom wall 98 of the guide rails 86 to the top wall 92 of the support bars 88 preferably should be less than 0.5 times the diameter of the cleaning bodies so that contact between side walls 100 of the guide rails 86 and the cleaning bodies 54 is 90° and thereby minimize any frictional contact therebetween since the contact point is at the horizontal axis of rotation of the cleaning body.

A gap "G" is provided between an edge of the top wall 92 of the support bar 88 and an edge of the bottom wall 98 of the guide bar 86, whereby reduced fluid pressure drops are realized as compared to the more closely spaced sieve bar configurations of the prior art. Additionally, forces necessary to rotate the sieve portions 76 and 78 are reduced as a result of the provisions for gaps "G", as well as reducing the amounts of smaller pieces of debris which might be trapped on the sieve portions 76 and 78 permits the more facile removal of lodged debris during backwashing by the hereinabove discussed counter-flow principle.

While the present invention has been described in the context of cleaning the internal surface of tubes of a surface condenser, it is understood that the present invention may be used for any application for the cleaning of the internal surface of tubes, whether or not in the context of heat transfer unit operations, provided that the liquid to be passed through the tubes of such unit is compatible with the cleaning bodies and that there is a definite need for periodic cleansing of such tube surfaces for fluid flow considerations vice heat transfer factors. Additionally, while the sieve portions 76 and 78 are in a preferred embodiment, i.e. support bars 88 equidistantly spaced between proximate guide bars 86 to provide for maximum rolling moment of the cleaning bodies, it is understood that such relationship may be one other than that of even spacing and yet provide for adequate separating and collecting capabilities.

Additionally, while sieve assembly of the present invention has been described with reference to the separation and collection of a cleaning body comprised of a core from which radially extend a plurality of filaments, the ends of which define a superficial diameter of the cleaning body, it will be understood that the present invention is applicable to the separation and collection of any form of spherical cleaning body.

Numerous provisions and variations of the present invention are possible in light of the above teachings and, therefore, within a scope of the appended claims, the invention may be practiced otherwise than as described.

What is claimed is:

1. In an apparatus having tubes in which the internal surface is subjected to the build-up of a deleterious scale formation, an assembly for effecting the removal of such scale from said internal surface of said tubes which comprises: a source of fluid, conduit means for passing said fluid through said tubes, means for introducing a plurality of cleaning bodies having a predetermined diameter into said fluid prior to passage through said tubes conduit means for receiving said fluid after passage through said tubes, sieve means for separating said cleaning bodies from said fluid after passage through said tubes, and means for collecting and recycling said cleaning bodies to said conduit means, an improved sieve assembly for said sieve means comprising:

a plurality of guide rails having a top wall, a bottom wall and side walls, said side walls being spaced a distance at least equal to said diameter of said cleaning bodies;

support bars including a top wall and bottom wall disposed between respective guide rails, said top wall of said guide rail extending above said top wall of said support rail a distance of at least one-half of said diameter of said cleaning bodies and said bottom wall of said guide rail being spaced from said top wall of said support rail of less than one-half of said superficial diameter of said cleaning bodies; and means for mounting in relative juxtaposition said guide rails and said support bars.

2. The apparatus as defined in claim 1 wherein said top wall of said guide rail extends a distance greater than said diameter above said top wall of said support bar.

3. The apparatus as defined in claim 1 wherein said support bars are disposed equidistant between respective guide rails.

4. The apparatus as defined in claim 1 wherein said gude rails support bars are mounted for rotation about a shaft.

5. The apparatus as defined in claim 4 wherein said guide rails and support bars are commonly mounted to a rod assembly including spacer elements.

6. The apparatus as defined in claim 1 wherein said assembly is a surface condenser.

7. The apparatus as defined in claim 1 wherein said sieve assembly is planar and two of said sieve assemblies form said sieve means and wherein said sieve assemblies extend upwardly in the form of an inverted V into said receiving conduit means.

8. The apparatus as defined in claim 7 wherein each of said sieve assemblies are mounted for rotation about shaft.

9. An improved sieve assembly for dispostion in a conduit for separating cleaning bodies from a fluid after passage through tubular surfaces, which comprises:

a plurality of guide rails having a top wall, a bottom wall and side walls, said side walls being spaced a distance at least equal to said diameter of said cleaning bodies;

support bars including a top wall and bottom wall disposed between respective guide rails, said top wall of said guide rail extending above said top wall of said support rail a distance of at least one-half of said diameter of said cleaning bodies and said bottom wall of said guide rail being spaced from said top wall of said support rail of less than one-half of said superficial diameter of said cleaning bodies; and means for mounting in relative juxtaposition said guide rails and said support bars.

10. The improved sieve assembly as defined in claim 9 wherein said top surface of said plurality of guide rails define a plane.

11. The improved sieve assembly as defined in claim 9 wherein said top wall of said guide rail extends a distance greater than said daimeter above said top wall of said support bar.

12. The improved sieve assembly as defined in claim 9 wherein said support bars are mounted on a shaft.

13. The improved sieve assembly as defined in claim 9 wherein said guide rails and said support bars are mounted on a rod assembly.

14. The improved sieve assembly as defined in claim 9 wherein said support bars are disposed equidistant between respective guide rails.

* * * * *